US009388997B2

(12) United States Patent
Yoshii et al.

(10) Patent No.: US 9,388,997 B2
(45) Date of Patent: Jul. 12, 2016

(54) AIR-CONDITIONING CONTROL APPARATUS

(75) Inventors: Katsuji Yoshii, Tokyo-to (JP); Shigeru Okada, Gunma-ken (JP); Kazuhiro Sekiguchi, Gunma-ken (JP); Shigeo Tera, Gunma-ken (JP); Junya Nakasone, Kiryu (JP); Koichi Yamana, Itami (JP); Yoshiaki Gouda, Tokyo-to (JP); Masaaki Meguro, Ashikaga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1565 days.

(21) Appl. No.: 13/017,720

(22) Filed: Jan. 31, 2011

(65) Prior Publication Data

US 2011/0186644 A1 Aug. 4, 2011

(30) Foreign Application Priority Data

Jan. 20, 2010 (JP) ..... 2010-019530
Jan. 29, 2010 (JP) ..... 2010-019532
Jan. 29, 2010 (JP) ..... 2010-019533

(51) Int. Cl.
*G05D 23/19* (2006.01)
*F24F 11/00* (2006.01)

(52) U.S. Cl.
CPC ..... *F24F 11/0034* (2013.01)

(58) Field of Classification Search
CPC ..... F24F 1/00; F24F 1/0014; F24F 3/00; F24F 7/06; F24F 7/08; F24F 7/10; F24F 11/001; F24F 11/0012; F24F 11/0034; F24F 11/006; F24F 11/0076; F24F 11/0079; F24F 13/06; F24F 13/08; F24F 2001/0048; F24F 2001/0055; F24F 2003/005; F24F 2007/001; F24F 2007/003; F24F 2011/0035; F24F 2013/00
USPC ..... 62/126, 129, 158, 178, 180, 186; 236/1 B, 1 C, 46 R, 49.3, 251; 165/208
See application file for complete search history.

(56) References Cited

U.S. PATENT DOCUMENTS 4,931,948 A * 6/1990 Parker et al. ..... 700/277
5,326,028 A 7/1994 Kano et al.

(Continued)

FOREIGN PATENT DOCUMENTS

EP 2123986 A1 11/2009
JP 61-159043 A 7/1986

(Continued)

OTHER PUBLICATIONS

Shino, Person Response System and Program, Oct. 7, 2004, JP2004278912A, Whole Document.*

(Continued)

*Primary Examiner* — M. Alexandra Elve
*Assistant Examiner* — Larry Furdge
(74) *Attorney, Agent, or Firm* — Osha Liang LLP

(57) ABSTRACT

An air-conditioning control apparatus for controlling an air conditioner configured to supply conditioned air into a space to be air-conditioned so that a temperature of a predetermined section in a plurality of sections in the space to be air-conditioned becomes a set temperature, the air-conditioning control apparatus comprising:

a detecting device configured to determines the number of people in the predetermined section; and a controller configured to correct the set temperature so as to be decreased if the number of people is increased and so as to be increased if the number of people is decreased.

6 Claims, 13 Drawing Sheets

(56) References Cited

U.S. PATENT DOCUMENTS

| | | | | | |
|---|---|---|---|---|---|
| 5,331,825 | A | | 7/1994 | Kim | |
| 5,361,982 | A | * | 11/1994 | Liebl | G05D 23/1904 236/46 R |
| 6,478,233 | B1 | * | 11/2002 | Shah | G05D 23/1904 236/46 R |
| 2002/0134849 | A1 | * | 9/2002 | Disser | 236/47 |
| 2007/0149109 | A1 | * | 6/2007 | Gu et al. | 454/256 |
| 2007/0241203 | A1 | | 10/2007 | Wagner et al. | |
| 2008/0277486 | A1 | * | 11/2008 | Seem et al. | 236/49.3 |

FOREIGN PATENT DOCUMENTS

| | | | | | |
|---|---|---|---|---|---|
| JP | 01147241 | A | * | 6/1989 | F24F 11/02 |
| JP | H03-102128 | A | | 4/1991 | |
| JP | H06-174283 | A | | 6/1994 | |
| JP | H0821651 | A | * | 1/1996 | |
| JP | 11311437 | A | | 11/1999 | |
| JP | 2001-027438 | A | | 1/2001 | |
| JP | 2001-304662 | A | | 10/2001 | |
| JP | 2004278912 | A | * | 10/2004 | |
| JP | 2005-221209 | A | | 8/2005 | |
| JP | 2006-145070 | A | | 6/2006 | |
| JP | 2007-107782 | A | | 4/2007 | |
| JP | 2008-298353 | A | | 12/2008 | |
| JP | 2008-304104 | A | | 12/2008 | |

OTHER PUBLICATIONS

Kazuyoshi et al., Air Conditioning Facility, Jan. 23, 1996, JPH0821651A, Whole Document.*

Office Action issued in corresponding Japanese Application No. 2010-019532 dated Aug. 6, 2013 (3 pages).

Office Action issued in corresponding Japanese Application No. 2010-019533 dated Aug. 6, 2013 (3 pages).

Patent Abstracts of Japan, Publication No. 61-159043, Published on Jul. 18, 1986, 1 page.

Extended European Search Report issued in corresponding European Application No. 11152740.4 dated Sep. 4, 2012 (7 pages).

* cited by examiner

15

EXAMPLE OF SET TEMPERATURE IF PERSON IS DETECTED IN SECTION 7 DURING COOLING

| | | | |
|---|---|---|---|
| 28°C (1) | 28°C (5) | 28°C (9) | 28°C (13) |
| 27°C (2) | 27°C (6) | 27°C (10) | 28°C (14) |
| 27°C (3) | 26°C (7) | 27°C (11) | 28°C (15) |
| 27°C (4) | 27°C (8) | 27°C (12) | 28°C (16) |

FIG. 10

15

EXAMPLE OF SET TEMPERATURE IF PERSON IS DETECTED IN SECTION 13 DURING COOLING

| | | | |
|---|---|---|---|
| 29°C (1) | 28°C (5) | 27°C (9) | 26°C (13) |
| 29°C (2) | 28°C (6) | 27°C (10) | 27°C (14) |
| 29°C (3) | 28°C (7) | 28°C (11) | 28°C (15) |
| 29°C (4) | 29°C (8) | 29°C (12) | 29°C (16) |

FIG. 11

15

EXAMPLE OF SET TEMPERATURE IF PERSON IS DETECTED IN SECTIONS 7 AND 13 DURING COOLING

| | | | |
|---|---|---|---|
| 28°C (1) | 28°C (5) | 27°C (9) | 26°C (13) |
| 27°C (2) | 27°C (6) | 27°C (10) | 27°C (14) |
| 27°C (3) | 26°C (7) | 27°C (11) | 28°C (15) |
| 27°C (4) | 27°C (8) | 27°C (12) | 28°C (16) |

FIG. 12

15

EXAMPLE OF SET TEMPERATURE AND INTAKE/EXHAUST SPOT IF PERSON IS PRESENT IN SECTION 7 DURING COOLING

| | | | |
|---|---|---|---|
| PLACE OF EXHAUST<br>28°C<br>(1) | 28°C<br>(5) | 28°C<br>(9) | PLACE OF INTAKE<br>28°C<br>(13) |
| 27°C<br>(2) | 27°C<br>(6) | 27°C<br>(10) | 28°C<br>(14) |
| 27°C<br>(3) | 26°C<br>(7) | 27°C<br>(11) | 28°C<br>(15) |
| 27°C<br>(4) | 27°C<br>(8) | 27°C<br>(12) | 28°C<br>(16) |

FIG. 14

AIR-CONDITIONING CONTROL APPARATUS

CROSS-REFERENCE TO RELATED APPLICATION

This application claims the benefit of priority to Japanese Patent Application No. 2010-19530, No. 2010-19532, and No. 2010-19533, all filed Jan. 29, 2010, of which full contents are incorporated herein by reference.

BACKGROUND OF THE INVENTION

1. Field of the Invention

The present invention relates to an air-conditioning control apparatus.

2. Description of the Related Art

For example, in an office and the like in an office building, a plurality of air conditioners might be disposed in order to condition air inside the office. In such an office, in order to suppress power consumption of the air conditioner, an operation condition of the air conditioner might be made different between a region where a person is present and a region where a person is not present (See Japanese Patent Laid-Open No. 11-311437, for example).

If the number of people in the region where people are present is also changed, a heat generation amount in the region with people is changed. Thus, if the number of people in a region is decreased and the heat generation amount is also decreased, when the air conditioner is operating under the same condition as before the decrease of the number of people, power might be consumed wastefully. Also, if the number of people in a region is increased and the heat generation amount is also increased, the temperature of the region might be increased.

SUMMARY OF THE INVENTION

An air-conditioning control apparatus for controlling an air conditioner configured to supply conditioned air into a space to be air-conditioned so that a temperature of a predetermined section in a plurality of sections in the space to be air-conditioned becomes a set temperature, the air-conditioning control apparatus according to an aspect of the present invention, comprises:

a detecting device configured to determines the number of people in the predetermined section; and a controller configured to correct the set temperature so as to be decreased if the number of people is increased and so as to be increased if the number of people is decreased.

BRIEF DESCRIPTION OF THE DRAWINGS

For more thorough understanding of the present invention and advantages thereof, the following description should be read in conjunction with the accompanying drawings, in which:

FIG. 10 is a diagram illustrating an example of a set temperature of each section calculated by a temperature calculation unit 102 if a person is detected in a section 7;

FIG. 11 is a diagram illustrating an example of the set temperature of each section calculated by the temperature calculation unit 102 if a person is detected in a section 13;

FIG. 12 is a diagram illustrating an example of the set temperature of each section calculated by the temperature calculation unit 102 if persons are detected in the sections 7 and 13;

FIG. 14 is a diagram for explaining temperature distribution and places of intake and exhaust if a person is detected in the section 7.

DETAILED DESCRIPTION OF THE INVENTION

At least the following details will become apparent from descriptions of this specification and of the accompanying drawings.

Figure 1:
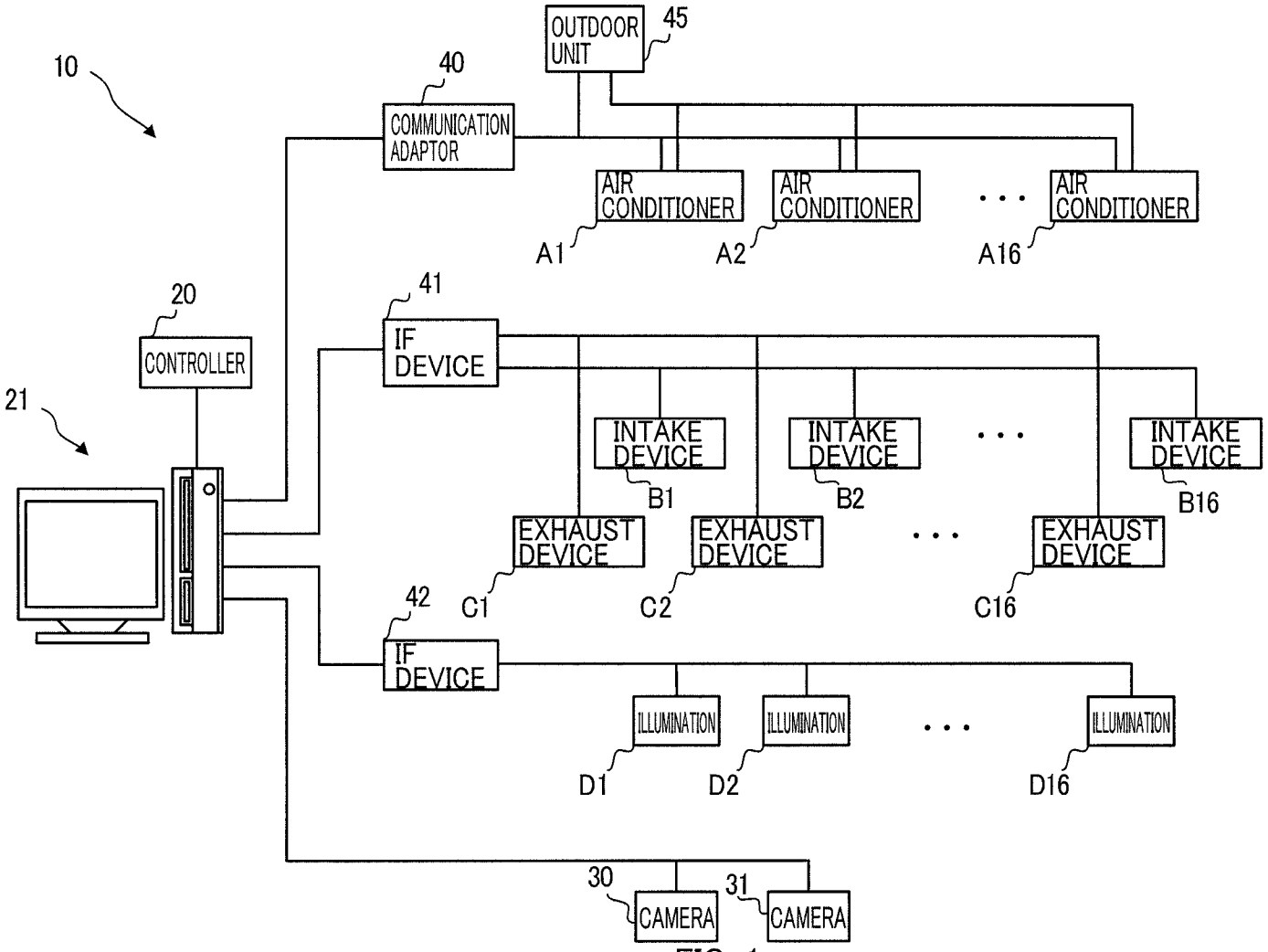
FIG. 1 is a diagram illustrating a configuration of an air-conditioning system 10, which is an embodiment of the present invention.
Figure 2:
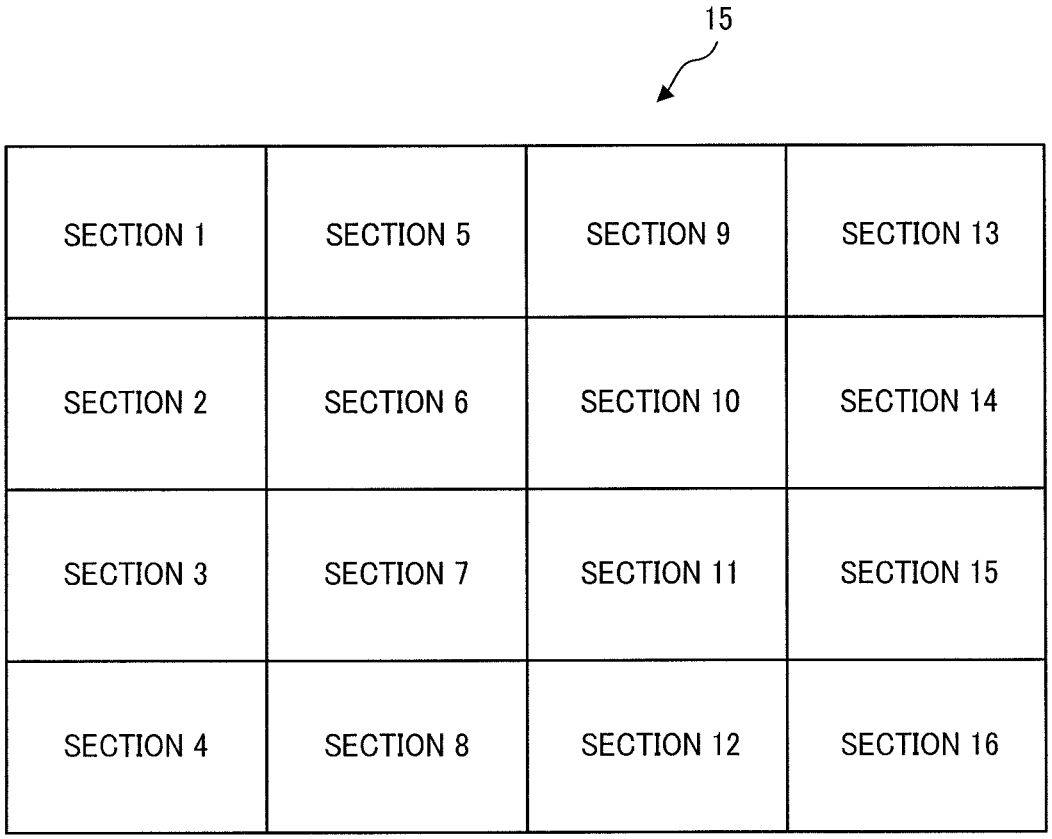
FIG. 2 is a plan view illustrating sections of an office 15.
Figure 3:
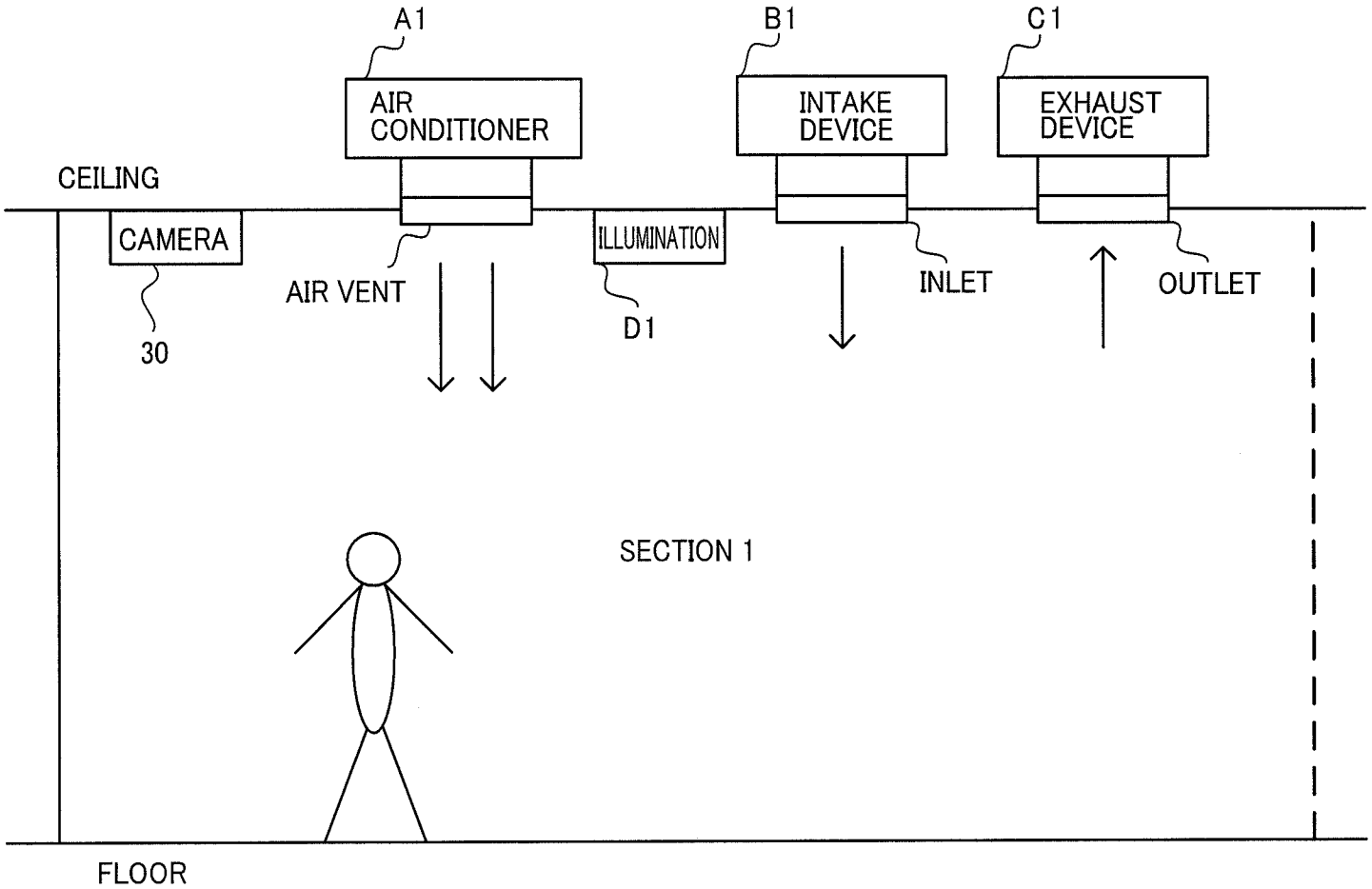
FIG. 3 is a side view of a section 1 in the office 15.

FIG. 1 is an embodiment of the present invention and is a diagram illustrating a configuration of an air-conditioning system 10 that conditions air in an office 15 in an office building, for example. FIG. 2 is a plan view illustrating sections of a space (space to be air-conditioned) in the office 15. The office 15 is divided into 16 virtual sections, that is, sections 1 to 16, for example. FIG. 3 is a side view of the section 1 in the office 15.

The air-conditioning system 10 includes a controller 20, a computer 21, cameras 30 and 31, a communication adaptor 40, an interface (IF: Interface) devices 41 and 42, an outdoor unit 45, air conditioners (indoor units) A1 to A16, intake devices B1 to B16, exhaust devices C1 to C16, and illuminations D1 to D16. The computer 21 and the cameras 30 and 31 correspond to the air-conditioning control apparatus.

The controller 20 is a so-called operation panel for a user to set on/off of the air conditioners A1 to A16, selection between cooling/heating, a temperature, an air amount and the like, for example. If the controller 20 is operated, intake amounts of the intake devices B1 to B16, exhaust amounts of the exhaust devices C1 to C16 and moreover, on/off and illuminance of the illuminations D1 of D16 are set. An operation result of the controller 20 is transmitted to the computer 21.

The computer 21 (controller) is a device that controls the air-conditioning system 10. Specifically, the computer 21 controls the air conditioners A1 to A16, the intake devices B1 to B16, the exhaust devices C1 to C16, and the illuminations D1 to D16 on the basis of the operation result of the controller 20 and images picked up by the cameras 30 and 31, which will be described later. Details of the computer 21 will be described later.

The camera 30 is disposed on a ceiling of the section 1 and shoots the space inside the office 15. The camera 31 is disposed on a ceiling of the section 16, for example, and shoots the space inside the office 15. All the regions in the office 15 are assumed to be shot by the cameras 30 and 31. Also, the computer 21 and the cameras 30 and 31 correspond to a detecting device.

The communication adaptor 40 connects the computer 21 to the air conditioners A1 to A16 and the outdoor unit 45 so that the computer 21 can control the air conditioners A1 to A16 and the outdoor unit 45.

The interface device (IF device) 41 connects the computer 21 to the intake devices B1 to B16 and the exhaust devices C1 to C16 so that the computer 21 can control the intake devices B1 to B16 and the exhaust devices C1 to C16.

The interface device 42 connects the computer 21 to the illuminations D1 to P16 so that the computer 21 can control the illuminations D1 to D16.

The outdoor unit 45 is connected to the air conditioners A1 to A16 and operates with the air conditioners A1 to A16 when the air conditioners A1 to A16 supply conditioned air.

The air conditioner A1 is disposed on the ceiling of the section 1 as shown in FIG. 3 and supplies conditioned air to the section 1 through an air vent in accordance with the control of the computer 21. The air conditioner A1 includes a storage device (not shown) that stores information relating to set temperatures, air amounts and the like and a temperature sensor (not shown). The air conditioner A1 supplies conditioned air so that the temperature of the section 1 (temperature of the temperature sensor) becomes a set temperature on the basis of information indicating the temperature of the temperature sensor and the set temperature. In this embodiment, the information stored in the storage device and indicating the set temperature is assumed to be the set temperature information.

The air conditioners A2 to A16 are disposed on the ceilings of the sections 2 to 16, respectively, and supply conditioned air to the sections 2 to 16 similarly to the air conditioner A1.

The intake device B1 is disposed on the ceiling of the section 1 and sucks air outside the office 15 through an inlet into the section 1 in accordance with the control of the computer 21.

The intake device B2 to B16 are disposed on the ceilings of the sections 2 to 16, respectively, and suck the outside air into the sections 2 to 16 similarly to the intake device B1. In each of the intake devices B1 to B16, a fan that sucks the outside air (not shown) is disposed.

The exhaust device C1 is disposed on the ceiling of the section 1 and exhausts air from the office 15 to the outside through an outlet in accordance with the control of the computer 21.

The exhaust devices C2 to C16 are disposed on the ceilings of the sections 2 to 16, respectively, and exhaust the air from the office to the outside similarly to the exhaust device C1. In each of the exhaust devices C1 to C16, a fan (not shown) that exhausts air form the office is disposed.

The illumination D1 is disposed on the ceiling of the section 1 and emits light in illuminance according to the control of the computer 21. The illuminations D2 to D16 are disposed on the ceilings of the sections 2 to 16, respectively, similarly to the illumination D1.

As described above, in this embodiment, on the ceiling of the section k (k is a natural number from 1 to 16), the air conditioner Ak, the intake device Bk, the exhaust device Ck and the illumination Dk are installed.

<<<First Embodiment>>>

Figure 4:
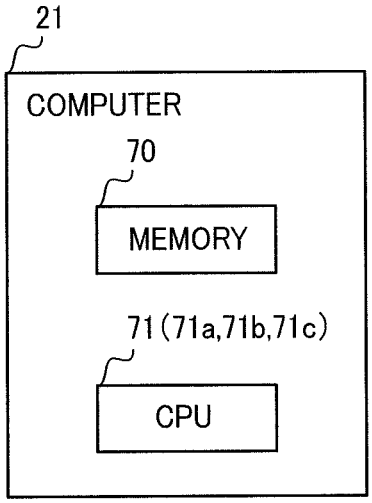
FIG. 4 is a diagram illustrating a configuration of a computer 21.

The computer 21 of a first embodiment includes, as shown in FIG. 4, a memory 70 and a CPU 71*a*.

Figure 5:
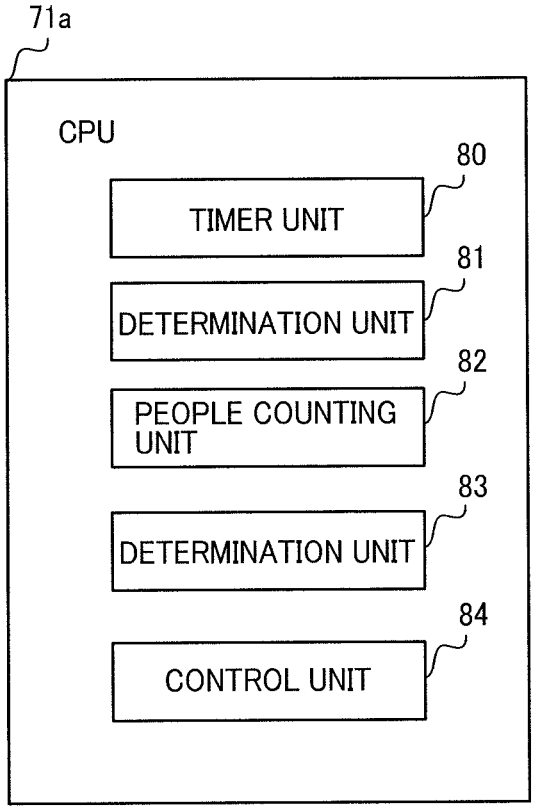
FIG. 5 is a diagram illustrating a functional block realized by a CPU 71*a* of a first embodiment.

The memory 70 stores program data to be executed by the CPU 71*a* and various data used when the CPU executes processing. The CPU 71*a* of the first embodiment realizes various functions by executing the program data stored in the memory 70. Specifically, the CPU 71*a* realizes functions of a timer unit 80, determination units 81 and 83, a people counting unit 82, and a control unit 84 as shown in FIG. 5.

The timer unit 80 (timer) generates time and date information indicating time and date and counts time.

The determination unit 81 determines if the current time is included in a predetermined time zone or not on the basis of time and date information. The predetermined time zone in this embodiment is assumed to be a time zone when employees working in the office 15 take a lunch break (12 pm to 1 pm). Thus, the determination unit 81 determines if the current time is included in the time zone of the lunch break or not, for example. The time zone of the lunch break corresponds to a first time zone, and a time zone different from the time zone of the lunch break corresponds to a second time zone.

The people counting unit 82 determines how many people are present in which section of the office 15 per predetermined time (three minutes, for example) on the basis of images from the cameras 30 and 31. Specifically, the people counting unit 82 obtains the number of people in each section per minute, for example. Then, the people counting unit 82 calculates an average of the number of people in each section every three minutes and determines the number of people in each section.

The determination unit 83 determines if an increase/decrease of the number of people in each section per predetermined time (three minutes, for example) is larger than a predetermined value or not on the basis of the determination result of the people counting unit 82. Specifically, the determination unit 83 determines if the number of increase in people per predetermined time is larger than "n" (first value) or not and also determines if the number of decrease in people is larger than "m" (second value) or not. Here, the determination unit 83 processes the number of decrease in people as a positive value.

If the controller 20 is operated, the control unit 84 controls the air conditioners A1 to A16, the intake devices B1 to B16, the exhaust devices C1 to C16, and the illuminations D1 to D16 in accordance with the operation result. Also, the control unit 84 controls the air conditioners A1 to A16 on the basis of an output of the timer unit 80 and the determination result of the determination unit 83 if the controller 20 is not operated. Specifically, the control unit 84 controls the air conditioners A1 to A16 so that the set temperatures of the air conditioners A1 to A16 are maintained during the time zone of the lunch break. Also, the control unit 84 decrease the set temperature of the air conditioner in a section only for a predetermined time period to (first time period) if the number of increase in people in the section is larger than "n" in the time zone other than the lunch break. Also, the control unit 84 increase the set temperature of the air conditioner in a section only for a predetermined time period tb (second period) if the number of decrease in people in the section is larger than "m". If the control unit 84 is to change the set temperature of the target air conditioner, the set temperature information stored in the storage device of the target air conditioner, that is, a value of the set temperature data is corrected.

==Example of Processing Executed by Computer 21 in the First Embodiment==

Figure 6:
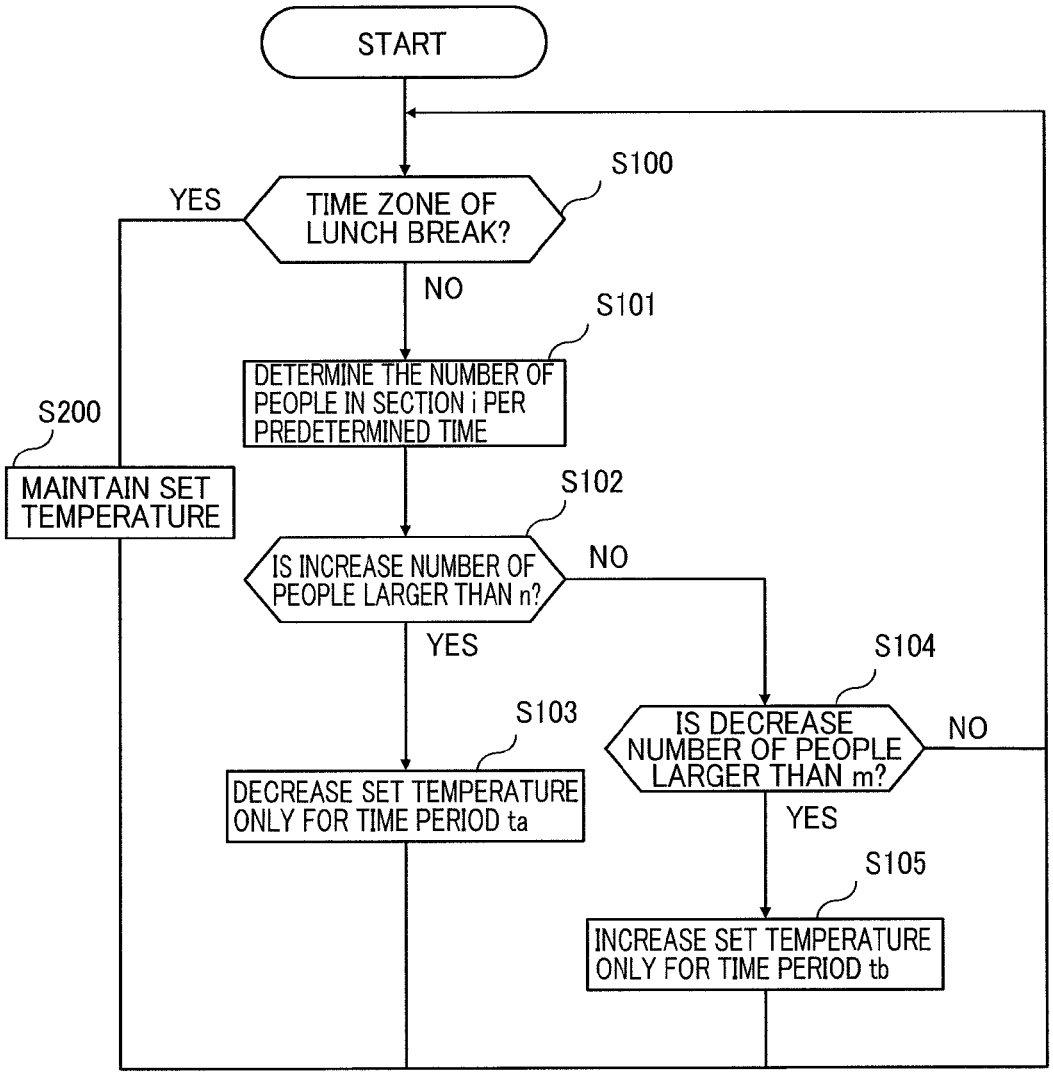
FIG. 6 is a flowchart illustrating an example of processing executed by the computer 21 of the first embodiment.

Here, an example of processing executed by the computer 21 in the first embodiment in a case in which the controller 20 is not operated will be described referring to FIG. 6. FIG. 6 illustrates processing executed for the section i, and the computer 21 executes the processing shown in FIG. 6 for all the sections 1 to 16.

First, the determination unit 81 determines if the current time is included in the time zone of the lunch break or not (S100), for example, on the basis of the time and date information generated by the timer unit 80. Then, if the current time is included in the time zone of the lunch break (S100; YES), the control unit 84 controls the air conditioner Ai (S200) so that the set temperature is maintained. And if the processing S200 is executed, the processing S100 is executed again.

On the other hand, if the current time is not included in the time zone of the lunch break (S100; NO), the people counting unit 82 determines the number of people in the section i per predetermined time (S101). Then, the determination unit 83 determines if the number of increase in people per predetermined time is larger than "n" or not (S102) on the basis of the determination result of the people counting unit 82 obtained per predetermined time. If the number of increase in people per predetermined time is larger than "n" (S102: YES), the control unit 84 decrease the set temperature of the air conditioner Ai in the section i only for the predetermined time period to (S103). If the processing S103 is executed, the processing S100 is executed again.

Also, if the number of increase in people per predetermined time is not larger than "n" (S102: NO), the determination unit 83 determines if the number of decrease in people per predetermined time is larger than "m" or not (S104). If the number of decrease in people is larger than "m" (S104: YES), the control unit 84 increase the set temperature of the air conditioner Ai in the section i only for the predetermined time period tb (S105). If the processing S105 is executed, the processing S100 is executed again. Also, if the number of decrease in people per predetermined time is not larger than "m" (S104: NO), the processing S100 is executed.

As described above, the computer 21 maintains the set temperature of the air conditioner Ai during the time zone of the lunch break and controls the air conditioner Ai on the basis of the number of people present in the office 15 during the time zone other than the lunch break. Also, in this embodiment, even if the number of people in the section i is changed, if the change is not larger than "n" or "m", the set temperature of the air conditioner Ai is maintained.

==Operation of Air-Conditioning System 10 in the First Embodiment==

Here, an operation of the air-conditioning system 10 of the first embodiment if the number of people in the section 7 is changed, for example, will be described. Here, suppose that the number of people in the section 7 is increased from 3 to 20 at 10 o'clock and in the lunch break (12 pm), the number of people in the section 7 is decreased from 20 to 2. It is assumed that the controller 20 has been operated in advance, and the set temperature of the entire office 15, that is, the set temperatures of all the air conditioners are set at 26° C. (cooling), for example. Also, the above-described "n" and "m" are assumed to be "5", for example, and the predetermined time periods to and tb are assumed to be 30 minutes, for example.

First, in the time zone before the lunch break, the people counting unit 82 executes the processing S101 and determines the number of people in the section 7 every 3 minutes. Thus, if 3 minutes have elapsed since 10 o'clock, for example, the people counting unit 82 determines that the number of people in the section 7 is increased from 3 to 20. Then, the determination unit 83 executes the processing S102 and determines that the number of increase in people in the section 7 is "17", which is larger than the predetermined value "5". As a result, the control unit 84 executes the processing S103 and decrease the set temperature of the air conditioner A7 by 1° C., for example, only for 30 minutes. Therefore, the set temperature of the air conditioner A7 in the section 7 becomes 25° C. for a period from 10:03 to 10:33, for example.

And if it is past 10:33, the control unit 84 changes the set temperature of the air conditioner A7 to the initial 26° C. After that, when it is 12:00 pm, the number of people in the section 7 is decreased from 20 to 2, but as described above, during the time zone of the lunch break, the set temperature is not changed. That is, even if it is 12 pm and the number of people in the section 7 is decreased, the set temperature of the air conditioner A7 is not increased.

Here, the operation of the air-conditioning system 10 if the number of people in the section 7 is increased by 17 at 10 am was described. Even if the number of people in the section 7 is decreased by 6 or more at 11 am, for example, the operation remains the same as the case of 10 o'clock except that the set temperature of the air conditioner A7 is increased by 1° C., for example. That is, in this case, from 11:03 to 11:33, the set temperature of the air conditioner A7 in the section 7 is 27° C. and then, changed to 26° C.

The air-conditioning system 10 of this embodiment was described. The computer 21 of the first embodiment determines the number of people in each section on the basis of the images from the cameras 30 and 31. Also, the computer 21 corrects the set temperature information so that the set temperature of the air conditioner A7 in the section 7 is decreased if the number of people in the section 7 is increased, for example. If the number of people in the section 7 is increased, a heat generation amount in the section 7 is increased. Thus, for example, in order to prevent a rise of the temperature in the section 7, an air amount of the air conditioner A7 needs to be increased. As a result, an excessive load is applied to the air conditioner A7, and power consumption might be increased. In this embodiment, if the number of people is increased, the set temperature of the air conditioner A7 is decreased, and thus, an excessive load is prevented from being applied to the air conditioner A7, for example. Also, the computer 21 corrects the set temperature information so that the set temperature of the air conditioner A7 in the section 7 is increased if the number of people in the section 7 is decreased, for example. If the number of people in the section 7 is decreased, the heat generation amount in the section 7 is decreased. Thus, if the air conditioner A7 is operated under the same condition as before the decrease of the number of people, power might be consumed wastefully. In this embodiment, if the number of people is decreased, the set temperature of the air conditioner A7 is increased, and thus, the power consumption consumed by the air conditioner A7 can be suppressed. Therefore, in this embodiment, if the number of people in the office 15 is changed, the power consumption of the air conditioners A1 to A16 can be suppressed.

Also, the computer 21 determines the number of people in the section 7 every three minutes and decrease the set temperature of the air conditioner A7 only if the number of increase in people in the section 7 for three minutes becomes larger than "5", for example. In general, if the increase in the number of people in the section 7 is as small as 1 to 2, for example, the heat generation amount in the section 7 is not largely increased. In this case, the computer 21 can reduce processing of the computer 21 since it does not change the set temperature of the air conditioner A7.

Also, the computer 21 increase the set temperature of the air conditioner A7 only if the number of decrease in people in the section 7 for three minutes becomes larger than "5", for example. In general, if the decrease in the number of people in the section 7 is as small as 1 to 2, for example, the heat generation amount in the section 7 is not largely decreased. In this case, the computer 21 can reduce processing of the computer 21 since it does not change the set temperature of the air conditioner A7.

Also, if the number of people in the section 7 is increased, for example, the heat generation amount is also increased, and the temperature of the section 7 might be increased. If the number of people in the section 7 is increased and the heat generation amount is increased, the computer 21 decrease the set temperature of the air conditioner A7 only for 30 minutes. Thus, in this embodiment, the power consumption can be reduced more than the case in which the set temperature of the air conditioner A7 is continuously decreased.

Also, if the number of people in the section 7 is decreased, for example, the heat generation amount is also decreased. If the number of people in the section 7 is decreased and the heat generation amount is decreased, the computer 21 increase the set temperature of the air conditioner A7 only for 30 minutes. Thus, in this embodiment, the temperature of the section 7 can be set at the desired set temperature while the power consumption is reduced as compared with the case in which the set temperature of the air conditioner A is not changed, for example.

Also, in general, when the lunch break is started, the number of people in the office 15 is decreased, and when the lunch break is finished, the number of people is increased. Thus, if the set temperatures of the air conditioners A1 to A16 are increased on the basis of the decrease in the number of people when the lunch break is started, the temperature of the office 15 might be rapidly increased at the timing of increase in the number of people when the lunch break is finished, for example. As a result, the power consumption of the air conditioners A1 to A16 is increased. The computer 21 maintains the set temperatures of the air conditioners A1 to A16 during the time zone of the lunch break, while it controls the air conditioners A1 to A16 on the basis of the number of people present in the office 15 in the time zone other than the lunch break. Thus, the computer 21 can operate the air conditioners A1 to A16 efficiently.

<<<Second Embodiment>>>

The computer 21 in the second embodiment also includes, as shown in FIG. 4, the memory 70 and the CPU 71*b*.

Figure 7:
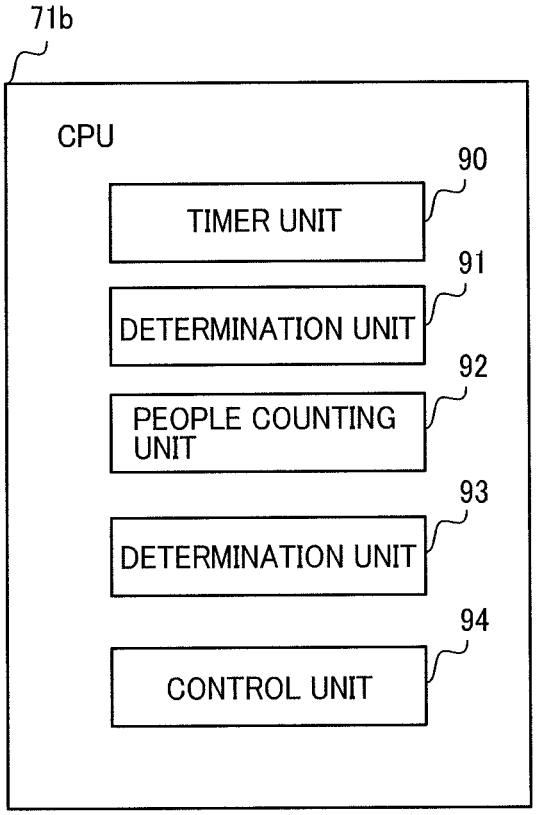
FIG. 7 is a diagram illustrating a functional block realized by the CPU 71*b* of a second embodiment.

The CPU 71*b* in the second embodiment realizes various functions by executing the program data stored in the memory 70. Specifically, the CPU 71*b* in the second embodiment realizes functions of a timer unit 90, determination units 91 and 93, a people counting unit 92, and a control unit 94 as shown in FIG. 7.

The timer unit 90 (timer) generates time and date information indicating time and date and counts time.

The determination unit 91 determines if the current time is included in a predetermined time zone or not. The predetermined time zone in this embodiment is assumed to be a time zone when employees working in the office 15 take a lunch break (12 pm to 1 pm), for example. Thus, the determining unit 91 determines if the current time is included in the time zone of the lunch break or not, for example. The time zone of the lunch break corresponds to the first time zone, and a time zone different from the time zone of the lunch break corresponds to the second time zone.

The people counting unit 92 determines how many people are present in which section of the office 15 per predetermined time (three minutes, for example) on the basis of the images from the cameras 30 and 31. Specifically, the people counting unit 92 obtains the number of people of each section per minute, for example. Then, the people counting unit 92 calculates an average of the number of people in each section every three minutes and determines the number of people in each section.

The determination unit 93 determines if an increase/decrease of the number of people in each section is larger than a predetermined value or not per predetermined time (three minutes, for example) on the basis of the determination result of the people counting unit 92. Specifically, the determination unit 93 determines if the number of increase in people per predetermined time is larger than "n" (first value) or not and also determines if the number of decrease in people per predetermined time is larger than "m" (second value) or not. Here, the determination unit 93 processes the number of decrease in people as a positive value.

If the controller 20 is operated, the control unit 94 controls the air conditioners A1 to A16, the intake devices B1 to B16, the exhaust devices C1 to C16, and the illuminations D1 to D16 in accordance with the operation result. Also, the control unit 94 controls the air conditioners A1 to A16 on the basis of an output of the timer unit 90 and the determination result of the determination unit 93 if the controller 20 is not operated. Specifically, the control unit 94 controls the air conditioners A1 to A16 so that the air amounts of the air conditioners A1 to A16 are maintained during the time zone of the lunch break. Also, the control unit 94 increases the air amount of the air conditioner in a section only for a predetermined time period to (first period) if the number of increase in people in the section is larger than "n" in the time zone other than the lunch break. Also, the control unit 94 decreases the air amount of the air conditioner in a section only for a predetermined time period tb (second time period) if the number of decrease in people in the section is larger than "m". If the control unit 94 is to change the air amount of the target air conditioner, air amount information stored in the storage device of the target air conditioner, that is, a value of the air amount data is corrected.

==Example of Processing Executed by Computer 21 in the Second Embodiment==

Figure 8:
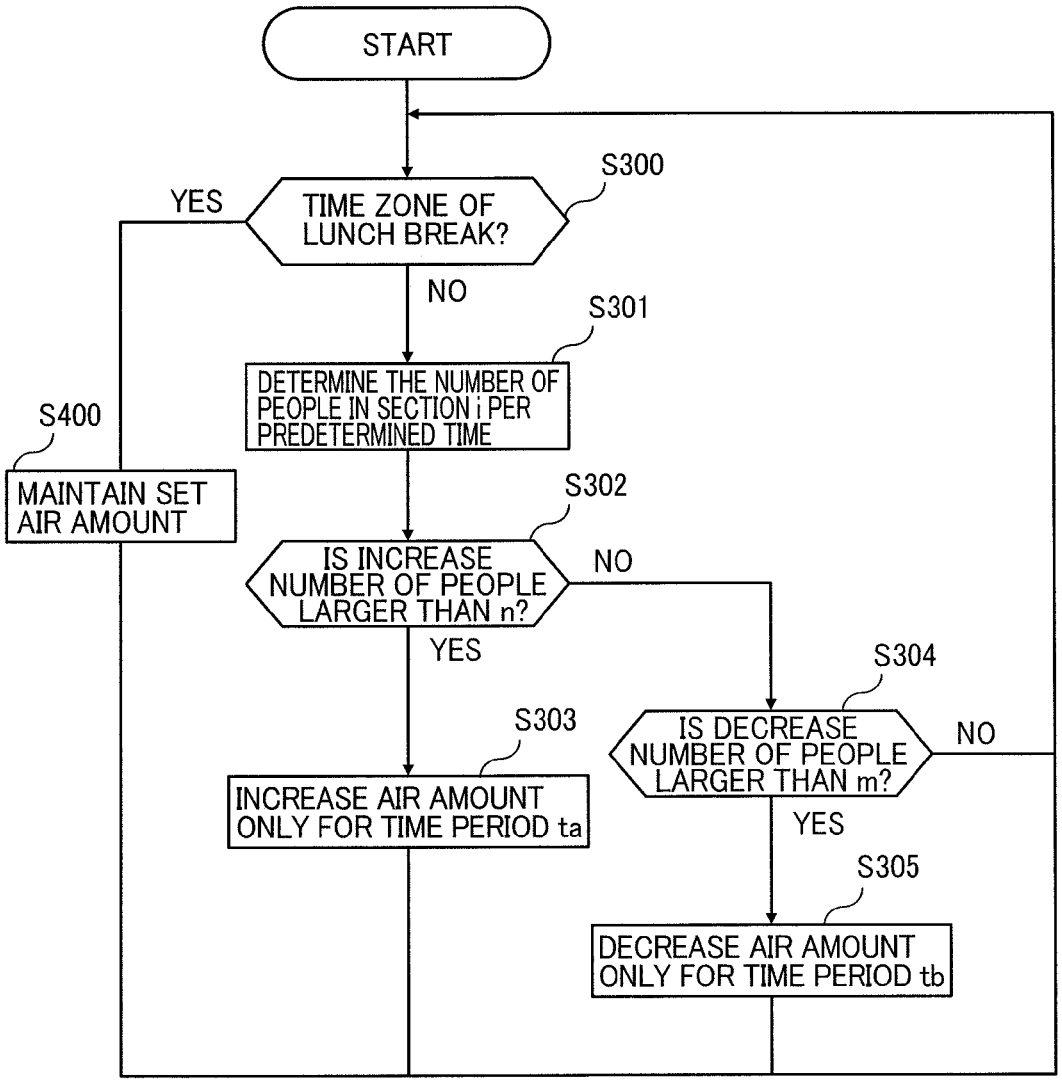
FIG. 8 is a flowchart illustrating an example of processing executed by the computer 21 of the second embodiment.

Here, an example of processing executed by the computer 21 in the second embodiment if the controller 20 is not operated will be described referring to FIG. 8. FIG. 8 illustrates processing executed for the section i, and the computer 21 executes the processing shown in FIG. 8 for all the sections 1 to 16.

First, the determination unit 91 determines if the current time is included in the time zone of the lunch break or not (S300), for example, on the basis of the time and date information generated by the timer unit 90. Then, if the current time is included in the time zone of the lunch break (S300; YES), the control unit 94 controls the air conditioner Ai (S400) so that the air amount is maintained. And if the processing S400 is executed, the processing S300 is executed again.

On the other hand, if the current time is not included in the time zone of the lunch break (S300; NO), the people counting unit 92 determines the number of people in the section i per predetermined time (S301). Then, the determination unit 93 determines if the number of increase in people per predetermined time is larger than "n" or not (S302) on the basis of the determination result of the people counting unit 92 obtained per predetermined time. If the number of increase in people per predetermined time is larger than "n" (S302: YES), the control unit 94 increases the air amount of the air conditioner Ai in the section i only for the predetermined time period to (S303). If the processing S303 is executed, the processing S300 is executed again.

Also, if the number of increase in people per predetermined time is not larger than "n" (S302: NO), the determination unit 93 determines if the number of decrease in people per predetermined time is larger than "m" or not (S304). If the number of decrease in people is larger than "m" (S304: YES), the control unit 94 decreases the air amount of the air conditioner Ai in the section i only for the predetermined time period tb (S305). If the processing S305 is executed, the processing S300 is executed again. Also, if the number of decrease in people per predetermined time is not larger than "m" (S304: NO), the processing S300 is executed.

As described above, the computer 21 maintains the air amount of the air conditioner Ai during the time zone of the lunch break and controls the air conditioner Ai on the basis of the number of people present in the office 15 during the time zone other than the lunch break. Also, in this embodiment, even if the number of people in the section i is changed, if the change is not larger than "n" or "m", the air amount of the air conditioner Ai is maintained.

==Operation of Air-Conditioning System 10 in the Second Embodiment==

Here, an operation of the air-conditioning system 10 of the second embodiment if the number of people in the section 7 is changed, for example, will be described. Here, suppose that the number of people in the section 7 is increased from 3 to 20 at 10 o'clock and in the lunch break (12 pm), the number of people in the section 7 is decreased from 20 to 2. It is assumed that the controller 20 has been operated in advance, and the set temperature of the entire office 15, that is, the set temperatures of all the air conditioners are set at 26° C. (cooling), for example. Also, the air amounts of all the air conditioners are set to the air amount of 60% of the maximum air amount, for example. Moreover, the above-described "n" and "m" are assumed to be "5", for example, and the predetermined time periods to and tb are assumed to be 30 minutes, for example.

First, in the time zone before the lunch break, the people counting unit 92 executes the processing S301 and determines the number of people in the section 7 every 3 minutes. Thus, if 3 minutes have elapsed since 10 o'clock, for example, the people counting unit 92 determines that the number of people in the section 7 is increased from 3 to 20. Then, the determination unit 93 executes the processing S302 and determines that the number of increase in people in the section 7 is "17", which is larger than the predetermined value "5". As a result, the control unit 94 executes the processing S303 and increases the air amount of the air conditioner A7 by 10%, for example, only for 30 minutes. Therefore, the air amount of the air conditioner A7 in the section 7 becomes 70% for a period from 10:03 to 10:33, for example.

And if it is past 10:33, the control unit 94 changes the air amount of the air conditioner A7 to the initial 60%. After that, when it is 12:00 pm, the number of people in the section 7 is decreased from 20 to 2, but as described above, during the time zone of the lunch break, the air amount is not changed. That is, even if it is 12 pm and the number of people in the section 7 is decreased, the air amount of the air conditioner A7 is not changed.

Here, the operation of the air-conditioning system 10 if the number of people in the section 7 is increased by 17 at 10 am was described. Even if the number of people in the section 7 is decreased by 6 or more at 11 am, for example, the operation remains the same as the case of 10 o'clock except that the air amount of the air conditioner A7 is decreased by 10%, for example. That is, in this case, from 11:03 to 11:33, the air amount of the air conditioner A7 in the section 7 is 50% and then, changed to 60%.

The air-conditioning system 10 of this embodiment was described. The computer 21 of the second embodiment determines the number of people in each section on the basis of the images from the cameras 30 and 31. Also, the computer 21 controls the air conditioner A7 so that the air amount of the air conditioner A7 in the section 7 is increased if the number of people in the section 7 is increased, for example. Thus, the rise of the temperature in the section 7 can be prevented. Also, the computer 21 controls the air conditioner A7 so that the air amount of the air conditioner A7 in the section 7 is decreased if the number of people in the section 7 is decreased, for example. If the number of people in the section 7 is decreased, the heat generation amount in the section 7 is decreased. Thus, if the air conditioner A7 is operated under the same condition as before the decrease of the number of people, for example, power might be consumed wastefully. In this embodiment, if the number of people is decreased, the air amount of the air conditioner A7 is decreased, and thus, the power consumption consumed by the air conditioner A7 can be suppressed. Therefore, in this embodiment, the power consumption of the air conditioners A1 to A16 can be suppressed, while temperature rise in the sections 1 to 16 are suppressed.

Also, the computer 21 determines the number of people in the section 7 every three minutes and increases the air amount of the air conditioner A7 only if the number of increase in people in the section 7 for three minutes becomes larger than "5", for example. In general, if the increase in the number of people in the section 7 is as small as 1 to 2, for example, the heat generation amount in the section 7 is not largely increased. In this case, the computer 21 can reduce processing of the computer 21 since it does not change the air amount of the air conditioner A7.

Also, the computer 21 decreases the air amount of the air conditioner A7 only if the number of decrease in people in the section 7 for three minutes becomes larger than "5", for example. In general, if the decrease in the number of people in the section 7 is as small as 1 to 2, for example, the heat generation amount in the section 7 is not largely decreased. In this case, the computer 21 can reduce processing of the computer 21 since it does not change the air amount of the air conditioner A7.

Also, if the number of people in the section 7 is increased, for example, the heat generation amount is also increased, and the temperature of the section 7 might be increased. If the number of people in the section 7 is increased and the heat generation amount is increased, the computer 21 increases the air amount of the air conditioner A7 only for 30 minutes. Thus, in this embodiment, the power consumption can be reduced more than the case in which the air amount of the air conditioner A7 is continuously increased.

Also, if the number of people in the section 7 is decreased, for example, the heat generation amount is also decreased. If the number of people in the section 7 is decreased and the heat generation amount is decreased, the computer 21 decreases the air amount of the air conditioner A7 only for 30 minutes. Thus, in this embodiment, the temperature of the section 7 can be set at the desired set temperature while the power consumption is reduced as compared with the case in which the air amount of the air conditioner A7 is not changed, for example.

Also, in general, when the lunch break is started, the number of people in the office 15 is decreased, and when the lunch break is finished, the number of people is increased. Thus, if the air amounts of the air conditioners A1 to A16 are decreased on the basis of the decrease in the number of people when the lunch break is started, the temperature of the office 15 might be rapidly increased at the timing of increase in the number of people when the lunch break is finished, for example. As a result, the power consumption of the air conditioners A1 to A16 is increased. The computer 21 maintains the air amounts of the air conditioners A1 to A16 during the time zone of the lunch break, while it controls the air conditioners A1 to A16 on the basis of the number of people present in the office 15 in the time zone other than the lunch break. Thus, the computer 21 can operate the air conditioners A1 to A16 efficiently.

<<<Third Embodiment>>>

The computer 21 in the third embodiment also includes, as shown in FIG. 4, the memory 70 and the CPU 71*c*.

In the third embodiment, the memory 70 stores program data to be executed by the CPU 71*c* and positional data relating to installation positions of the air conditioners A1 to A16, the intake devices B1 to B16, the exhaust devices C1 to C16, and the illuminations D1 to D16 in the office 15. Moreover, the memory 70 stores intake/exhaust amount data indicating a relationship between the number of people enrolled in the office 15 and the required intake/exhaust amounts according to the enrolled people.

Figure 9:
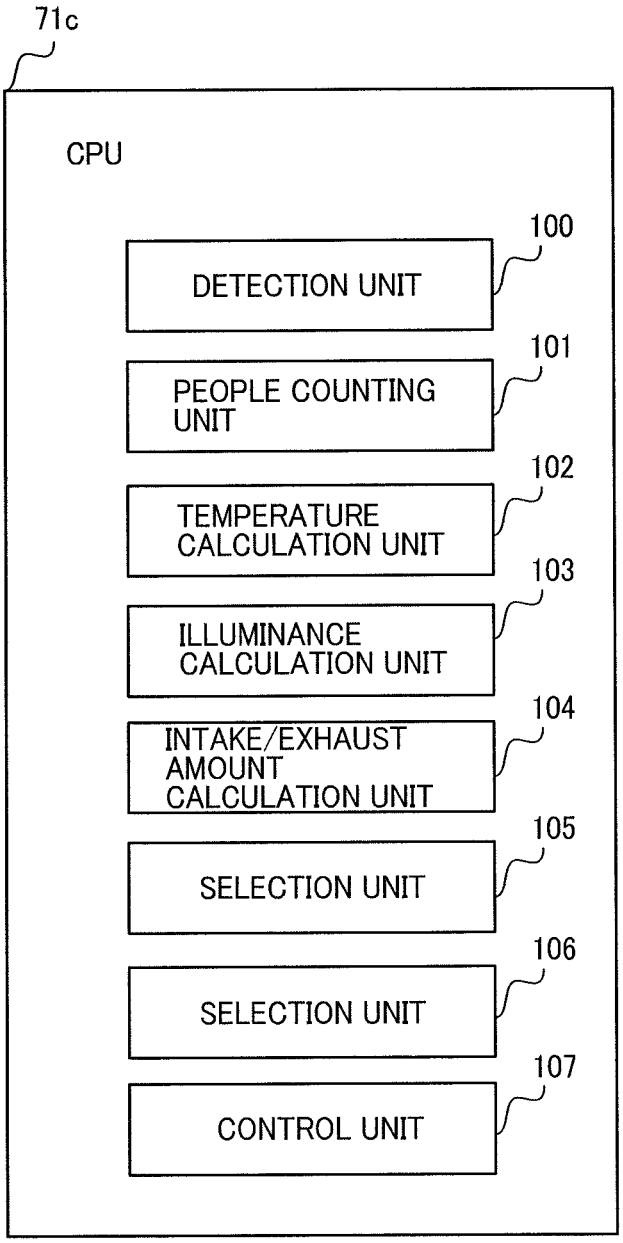
FIG. 9 is a diagram illustrating a functional block realized by the CPU 71*c* of a third embodiment.

The CPU 71*c* in the third embodiment realizes various functions by executing the program data stored in the memory 70. Specifically, the CPU 71*c* in the third embodiment realizes functions of a detection unit 100, a people counting unit 101, a temperature calculation unit 102, an illuminance calculation unit 103, an intake/exhaust amount calculation unit 104, selection units 105 and 106, and a control unit 107 as shown in FIG. 9.

The detection unit 100 detects presence of a person in the office 15 on the basis of the images form the cameras 30 and 31.

The people counting unit 101 determines how many people are in which section of the office 15 on the basis of the images from the cameras 30 and 31.

The temperature calculation unit 102 calculates a set temperature of each section on the basis of presence of a person in each section. Specifically, the temperature calculation unit 102 calculates a set temperature of each section so that a difference between a temperature of a section where a person is detected and an outside temperature outside the office 15 is larger than a difference between a temperature of a section where a person is not detected and the outside temperature. For example, during the cooling, the set temperature of each section is calculated so that the farter the section is located from the center, the higher the temperature becomes gradually, assuming the section where a person is detected as the center. That is, supposing that the temperature of the section where a person is detected is T1° C., the temperature calculation unit 102 sets the temperature of the sections adjacent to the section where a person is detected at (T1+1)° C. and moreover, the temperatures of the sections outside them at (T1+2)° C. However, an upper limit value is provided in the calculated temperature of each section so that the temperature of each section does not become equal to the outside temperature, for example. The upper limit value may be a fixed value, for example, or may be a value determined by a relationship with the outside temperature detected by the outside unit 45 or the like.

FIG. 10 is an example of the temperature of each section calculated by the temperature calculation unit 102 if a person is detected only in the section 7, for example. Also, FIG. 11 is an example of the temperature of each section calculated by the temperature calculation unit 102 if a person is detected only in the section 13, for example. Numerals in parentheses in FIGS. 10 and 11 indicate numbers of the sections.

Also, if there are two or more sections where a person is detected, the temperature calculation unit 102 selects the temperature with a larger difference from the outside temperature in the calculated temperatures of the sections. Specifically, if a person is detected in the sections 7 and 13, for example, the temperatures in the sections other than the sections 5, 10, and 15 are different between a case of calculation made around the section 7 and the case of calculation around the section 13 as the center. In this case, the temperature calculation units 102 selects, as shown in FIG. 12, the temperature where a difference between the temperature in each section and the outside temperature is large, that is, the lower temperature in each section, and sets it as the set temperature.

On the other hand, the temperature calculation unit 102 during heating calculates the set temperature of each section so that the farther from the center, the lower the temperature becomes gradually using the section where a person is detected as the center. That is, if the temperature of the section where a person is detected is assumed to be T2° C., for example, the temperature calculation unit 102 sets the temperature of the sections adjacent to the section where a person is detected to (T2−1)° C. and the temperature of the section outside them to (T2−2)° C. If there are two or more sections where a person is detected, during heating, too, similarly to the cooling, the temperature whose difference from the outside temperature is large is selected among the calculated temperature of the sections. However, a lower limit value is provided in the calculated temperature of each section so that the temperature of each section does not become equal to the outside temperature, for example. The lower limit value may be a fixed value, for example, or may be a value determined by a relationship with the outside temperature.

The illuminance calculation unit 103 calculates illuminance of illumination of each section on the basis of presence of a person in each section. Specifically, the illuminance calculation unit 103 calculates the illuminance of each section so that the farther from the center, the lower the illuminance of the illumination becomes gradually using the section where a person is detected as the center. If there are two or more sections where a person is detected, the illuminance calculation unit 103 selects the brighter illuminance among the calculated luminance of the sections.

The intake/exhaust amount calculation unit 104 calculates a required intake amount and exhaust amount in the office 15 on the basis of the number of people in the office 15 and the above-described intake/exhaust amount data. The intake amount and the exhaust amount calculated by the intake/exhaust amount calculation unit 104 become larger with an increase in the number of people.

The selection unit 105 selects the intake device that performs suction on the basis of the section where a person is detected and the positional data. Specifically, the selection unit 105 selects the intake device disposed at a position the farthest from the section where a person is detected. If an amount that can be sucked through the inlet of the selected intake device is less than the intake amount calculated by the intake/exhaust amount calculation unit 104, the selection unit 105 increases the number of intake devices to be selected until the total sum of the intake amounts through the selected intake devices becomes larger than the calculated intake amount. At this time, the selection unit 105 selects the intake devices in the order from the farthest from the section where a person is detected. Also, if there are two or more sections where a person is detected, the selection unit 105 selects the intake device such that the sum of the distances from each of the sections becomes the largest, for example.

The selection unit 106 selects the exhaust device that exhausts air based on the section where a person is detected, positional data, and the position of the intake device selected by the selection unit 105. Specifically, the selection unit 106 selects the exhaust device disposed at a position where the sum of the distance from the section where a person is detected and the distance from the position of the intake device selected by the selection unit 105 becomes the longest.

If the amount that can be exhausted by the outlet of the selected exhaust device is less than the exhaust amount calculated by the intake/exhaust amount calculation unit 104, the selection unit 106 increases the number of the exhaust devices to be selected until the total sum of the exhaust amounts of the selected exhaust devices becomes larger than the calculated exhaust amount. At this time, the selection unit 106 selects the intake device in the order from the larger sum of the distance from the section where a person is detected and the distance from the intake device selected by the selection unit 105. Also, if there are two or more sections where a person is detected, the selection unit 106 selects the exhaust devices such that the sum of the distance from each of the sections and the distance from the position of the intake device selected by the selection unit 105 becomes the largest.

The control unit 107 controls the air conditioners A1 to A16, the intake devices B1 to B16, the exhaust devices C1 to C16, and the illuminations D1 to D16 on the basis of the various information such as the operation result of the controller 20, the calculation results and the like. If the operation result of the controller 20 is outputted, the control unit 107 controls the devices such as the air conditioners A1 to A16 and the like in accordance with the operation result. On the other hand, if the operation result is not outputted from the controller 20, the control unit 107 controls the air conditioners A1 to A16 on the basis of the calculation result of the temperature calculation unit 102 and controls the illuminations D1 to D16 on the basis of the calculation result of the illuminance calculation unit 103. Moreover, the control unit 107 controls the intake devices B1 to B16 and the exhaust devices C1 to C16 on the basis of the calculation result of the intake/exhaust amount calculation unit 104 and the selection result of the selection units 105 and 106.

==Example of Processing Executed by Computer 21 in the Third Embodiment==

Figure 13:
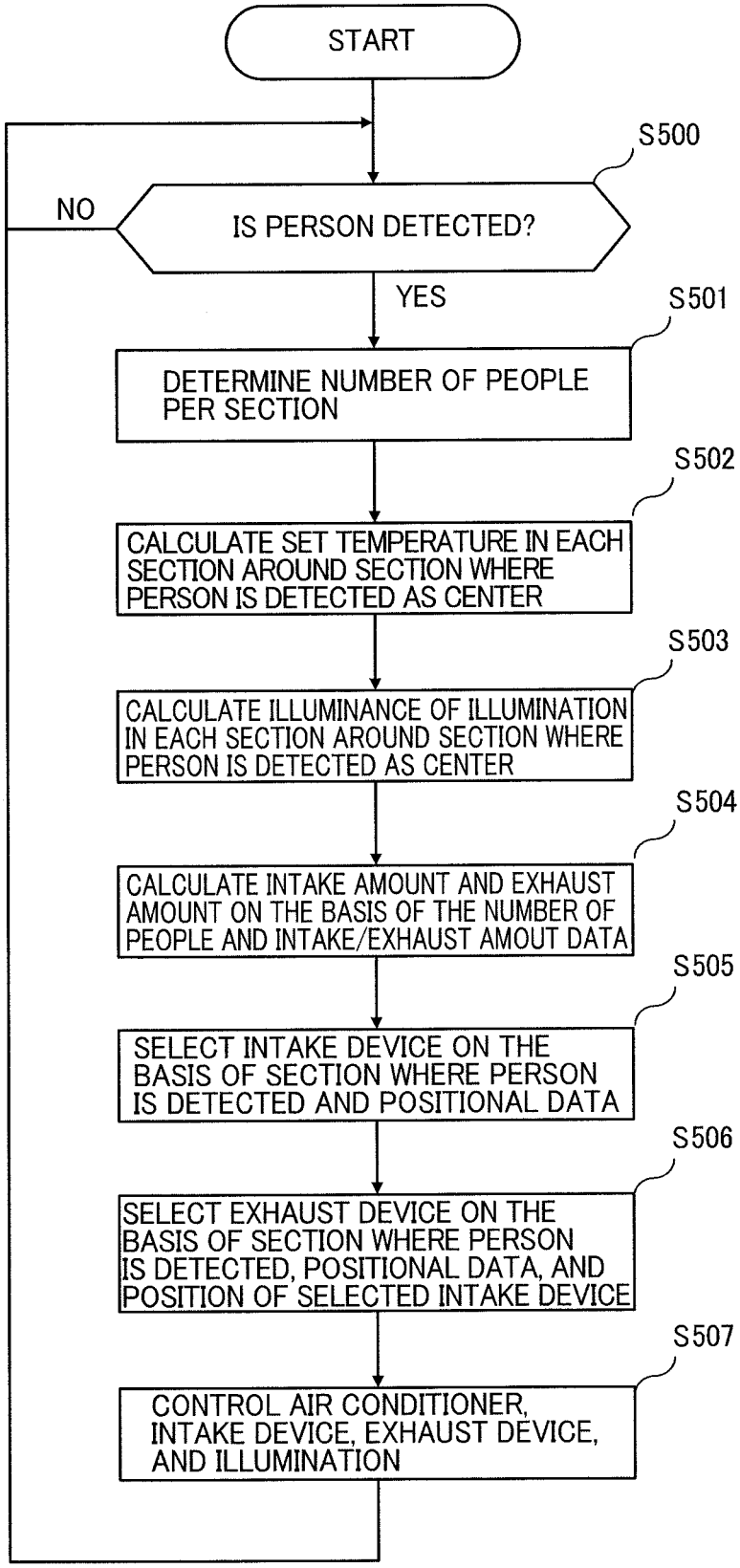
FIG. 13 is a flowchart illustrating an example of processing executed by the computer 21 of the third embodiment.

Here, an example of processing executed by the computer 21 of a third embodiment in a case in which the controller 20 is not operated will be described referring to FIG. 13.

First, the detection unit 100 detects presence of a person in the office 15 (S500). Then, if a person is detected (S500: YES), the people counting unit 101 determines the number of people in the office 15 for each section (S501). On the other hand, if a person is not detected (S500: NO), the detection unit 100 executes the processing S500. Then, the temperature calculation unit 102 calculates a set temperature of each section around the section where a person is detected as the center (S502). Also, the illuminance calculation unit 103 calculates illuminance of each section around the section where a person is detected as the center (S503).

Then, the intake/exhaust amount calculation unit 104 calculates required intake amount and exhaust amount in the office 15 on the basis of the number of people and the intake/exhaust amount data (S504). Moreover, the selection unit 105 selects the intake device to be controlled on the basis of the section where a person is detected and the positional data (S505). Also, the selection unit 106 selects the exhaust devices to be controlled on the basis of the section where a person is detected, the positional data, and the selection result of the selection unit 105 (S506). And the control unit 107 controls the air conditioners A1 to A16, the intake devices B1 to B16, the exhaust devices C1 to C16, and the illuminations D1 to D16 on the basis of various information such as the calculation results, selection results and the like (S507). If the processing S507 is executed, the processing S500 is executed again.

As described above, if the controller 20 is not operated, the computer 21 of this embodiment controls the devices such as the air conditioners A1 to A16 and the like on the basis of the number of people present in the office 15.

==Operation of Air-Conditioning System 10 of the Third Embodiment==

Here, referring to FIGS. 13 and 14, an operation during cooling of the air-conditioning system 10 of the third embodiment in a case in which there are three persons in the section 7 of the office 15, for example, will be described. Here, suppose that the controller 20 has been operated in advance, and the set temperature of the entire office 15, that is, the set temperatures of all the air conditioners are set at 26° C., for example. Also, it is assumed that luminance of all the illuminations are set to the maximum, and the intake amounts and the exhaust amounts are also set to the maximum. Also, here, the outside temperature is supposed to be at 35° C., for example, and the upper limit value during the cooling calculated by the above-described temperature calculation unit 102 is 30° C., for example.

First, on the basis of the images from the cameras 30 and 31, the detection unit 100 detects that there are people in the office 15 by executing the processing S500. Then, the people counting unit 101 determines that the number of people in the section 7 of the office 15 is 3 by executing the processing S501. The temperature calculation unit 102 executes the processing S502 and calculates a set temperature of each section around the section 7 as the center. Specifically, the temperature calculation unit 102 sets the temperature of the section 7 to 26° C. set by the controller 20 in advance and calculates the set temperature of each section so that the farther from the section 7, the higher the temperature becomes gradually as shown in FIG. 14. In this embodiment, the temperatures of the sections 2 to 4, 6, 8, and 10 to 12 are calculated as 27° C., and the temperatures of the sections 1, 5, 9, and 13 to 16 are calculated as 28° C., for example.

Then, the illuminance calculation unit 103 executes the processing S503 and calculates the illuminance of each section so that the farther from the section 7, the lower the illuminance of the illumination becomes gradually using the section 7 as the center. In this embodiment, the luminance of the sections 2 to 4, 6, 8, and 10 to 12 are calculated as 80% of the illuminance of the section 7, and the luminance of the sections 1, 5, 9, and 13 to 16 are calculated as 70% of the illuminance of the section 7.

The intake/exhaust amount calculation unit 104 calculates required intake amount and exhaust amount based on the number of people in the office 15, which is 3, and the intake/exhaust data by executing the processing S504. Here, it is assumed that the intake amount and the exhaust amount required for the three people can be sufficiently covered by any one of the intake devices B1 to B16 and any one of the exhaust devices C1 to C16.

Then, the selection unit 105 selects the intake device located at a position the farthest from the section 7, that is, the intake device B13 disposed in the section 13 by executing the processing S505. Moreover, the selection unit 106 selects the exhaust devices C1 disposed in the section 1 for which the sum of the distance from the section 7 and the distance from the section 13 becomes the largest by executing the processing S506. Then, the control unit 107 executes the processing S507 and controls the air conditioners A1 to A16, the intake devices B1 to B16, the exhaust devices C1 to C16, and the illuminations D1 to D16.

As a result, the set temperature in each section in the office 15 is changed as shown in FIG. 14. Moreover, the air outside is sucked only through the inlet of the intake device B13 in the section 13, and the air in the office 15 is exhausted only through the outlet of the exhaust devices C1 in the section 1.

That is, the intake devices other than the intake device B13 are stopped, and the exhaust devices other than the exhaust device C1 are stopped.

The air-conditioning system 10 of this embodiment was described above. The computer 21 of the third embodiment detects presence of a person in each section on the basis of the images from the cameras 30 and 31. Also, the computer 21 controls the air conditioners A1 to A16 so that a difference between the temperature of the section where a person is detected (the section 7, for example) and the outside temperature becomes larger than the difference between the temperatures of the sections other than the section 7 and the outside temperature as described in this embodiment. Moreover, the computer 21 controls the intake devices B1 to B16 so that the air outside is sucked through the inlet of the section 13, which is the farthest from the section 7, in the inlets of the intake devices B1 to B16. If the air in the office 15 is to be replaced, the air may be replaced using the predetermined outlet of the predetermined section and the inlet of the section 7 with a person. However, the rise of the temperature in the section 7 can be suppressed better by suctioning through the inlet in the section 13 than the suctioning of air through the inlet in the section 7. Therefore, in this embodiment, the air conditioners A1 to A16 can be operated efficiently while the air is replaced.

Also, if it is set such that the intake amounts through the intake devices B1 to B16 and the exhaust amounts through the exhaust devices C1 to C16 both become the maximum, sufficient ventilation can be performed regardless of the number of people in the office 15. However, in this case, since the amount of conditioned air to be replaced becomes large, the power consumption of the air conditioners A1 to A16 is increased. In this embodiment, the cameras 30 and 31 and the computer 21 determine the number of people in the section with a person by shooting the inside of the office 15. And the computer 21 controls the intake amount in accordance with the number of people in the section with a person as described above. Thus, in this embodiment, as compared with the case in which the intake amount is set at the maximum, the power consumption of the air conditioners A1 to A16 can be suppressed while the air in the office 15 is replaced as appropriate.

Also, as shown in this embodiment, the operation of the intake device B7 in the section 7 with a person is stopped. Thus, the intake amount of the inlet of the intake device B7 is zero or substantially zero. Therefore, in this embodiment, the air outside is sucked into the section with a person, and direct rise of the temperature in the section with a person by the air outside can be prevented.

Also, the computer 21 controls the intake amount of the inlet of the intake device B13, which is the farthest from the section 7 with a person, for example. Thus, an influence on the temperature of the section 7 with a person can be alleviated when the air in the office 15 is to be replaced.

Also, the set temperature of the section 7 with a person during the cooling is set the lowest in the office 15. If the air in the office 15 is exhausted through the outlet of the exhaust devices C7 in the section 7, for example, the most cooled air is exhausted, which is not preferable. The computer 21 controls the exhaust devices C1 to C16 so that the air is exhausted through the outlet of the exhaust devices C1 in the section 1, which is the farthest from the section 7 with a person and the amount through the outlet of the exhaust devices C7 in the section 7 with a person is zero. Thus, the air conditioners A1 to A16 can be operated efficiently in this embodiment.

Also, the computer 21 determines the exhaust amount through the outlet of the exhaust devices C1 on the basis of the number of people in the section 7. Thus, as compared with the case in which the exhaust amount in the office 15 is set at the maximum, the power consumption of the air conditioners A1 to A16 can be suppressed while the air in the office 15 is replaced as appropriate.

For example, an infrared sensor or the like that detects presence of a person may be disposed in each of the sections 1 to 16 instead of the cameras 30 and 31, for example. Even if such infrared sensor is used, it is possible to determine a section with a person and a section without a person. Thus, it may be so configured that the computer 21 of the third embodiment sets temperature distribution of each section on the basis of an output of the infrared sensor.

Also, the computer 21 of the third embodiment sets the set temperature around the section with a person as the center, but not limited to that. For example, it may be so configured that the computer 21 calculates a barycenter of a person on the basis of the position where a person is located in the office 15. And it may be so configured that the computer 21 changes the set temperature around the section including the position of the barycenter of a person as the center. If the position of the barycenter of a person is included in the section 7, for example, the computer 21 sets the temperature of each section similarly to the case shown in FIG. 11, for example.

Moreover, the computer 21 of the third embodiment may determine the position of intake/exhaust on the basis of the above-described position of the barycenter of a person.

Also, in the air-conditioning system having a configuration in which cooled air-conditioned air is supplied into a room to be air-conditioned from a plurality of air vents so that the temperature near each temperature sensor disposed in the room to be air-conditioned becomes the set temperature and provided with a plurality of outlets that exhaust the air in the room to be air-exhausted, a temperature setting unit that makes setting such that the set temperature becomes higher in order from the center position on the basis of the position of a person in the room to be air-conditioned toward the outer periphery side and an air-exhausted control unit that makes an exhaust amount of air through the outlet disposed at the position far from the center position larger than the exhaust amount of the outlet close to the center position than the outlet may be provided.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. An air-conditioning control apparatus of an air-conditioning system including a plurality of air conditioners disposed respectively in a plurality of sections in a space to be air-conditioned in order to set a temperature of each of the plurality of sections at a desired temperature, and a plurality of inlets for sucking air outside of the space to be air-conditioned into the space to be air-conditioned, the air-conditioning control apparatus comprising:

a detecting device configured to detect presence of a person in each of the plurality of sections; and a controller configured to control the plurality of air conditioners so that a difference between a temperature of a section where a person is detected among the plurality of sections and an outside temperature outside of the space to be air-conditioned is larger than a difference between a temperature of a section where a person is not detected among the plurality of sections and the outside temperature, and control an intake amount through the plurality of inlets so that a intake amount through the inlet, which is far from the section where a person is detected, among the plurality of inlets is larger than a intake amount through the inlet, which is close to the section where a person is detected, among the plurality of inlets.

2. The air-conditioning control apparatus according to claim 1, wherein the detecting device determines the number of people detected in each of the plurality of sections, and the controller controls the intake amount through each of the plurality of inlets in accordance with the number of people in the section where a person is detected.

3. The air-conditioning control apparatus according to claim 1, wherein the controller controls the intake amount through the inlet, which is close to the section where a person is detected, so as to becomes zero or substantially zero.

4. The air-conditioning control apparatus according to claim 1, wherein the controller controls the intake amount through the inlet, which is the farthest from the section where a person is detected, among the plurality of inlets.

5. The air-conditioning control apparatus according to claim 1, further comprising a plurality of outlets for exhausting air in the space to be air-conditioned to the outside, wherein the controller controls air exhaust amount through each of the plurality of outlets so that the air exhaust amount through the outlet, which is far from the section where a person is detected, among the plurality of outlets is larger than the air exhaust amount through the outlet, which is close to the section where a person is detected, among the plurality of outlets.

6. The air-conditioning control apparatus according to claim 5, further comprising a plurality of outlets for exhausting air in the space to be air-conditioned to the outside, wherein the controller controls air exhaust amount through each of the plurality of outlets so that the air exhaust amount through the outlet, which is far from the section where a person is detected, among the plurality of outlets is larger than the air exhaust amount through the outlet, which is close to the section where a person is detected, among the plurality of outlets.

* * * * *